US011165194B2

(12) United States Patent
Chen et al.

(10) Patent No.: US 11,165,194 B2
(45) Date of Patent: Nov. 2, 2021

(54) WATERPROOF COMMUNICATION PORT AND TERMINAL DEVICE EQUIPPED WITH WATERPROOF COMMUNICATION PORT

(71) Applicant: HUAWEI TECHNOLOGIES CO., LTD., Guangdong (CN)

(72) Inventors: Xiaoning Chen, Shenzhen (CN); Guizhen Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/318,049

(22) PCT Filed: Jul. 15, 2016

(86) PCT No.: PCT/CN2016/090199
§ 371 (c)(1),
(2) Date: Jan. 15, 2019

(87) PCT Pub. No.: WO2018/010173
PCT Pub. Date: Jan. 18, 2018

(65) Prior Publication Data

US 2021/0098934 A1 Apr. 1, 2021

(51) Int. Cl.
*H01R 13/52* (2006.01)
*H01R 43/00* (2006.01)

(52) U.S. Cl.
CPC ..... *H01R 13/5227* (2013.01); *H01R 13/5202* (2013.01); *H01R 13/5216* (2013.01); *H01R 43/005* (2013.01)

(58) Field of Classification Search
CPC ..... H01R 13/5227; H01R 13/5202; H01R 13/5216; H01R 43/005
See application file for complete search history.

(56) References Cited

U.S. PATENT DOCUMENTS 4,952,753 A * 8/1990 Hayashi ..... B60R 16/027 174/559
6,053,620 A 4/2000 Won
(Continued)

FOREIGN PATENT DOCUMENTS

CN 101316032 A 12/2008
CN 102025076 A 4/2011
(Continued)

OTHER PUBLICATIONS

Chinese Office Action issued in Chinese Application No. 201680080828.x dated Mar. 11, 2019, 6 pages.
(Continued)

*Primary Examiner* — Tho D Ta
(74) *Attorney, Agent, or Firm* — Fish & Richardson P.C.

(57) ABSTRACT

A waterproof communication port (2) and a terminal device equipped with the waterproof communication port (2) are provided and relate to the field of terminal device technologies. The waterproof communication port (2) includes a port body (21), a connecting groove (22) is provided on a connecting end of the communication port body (21), metal terminals (23) are provided inside the connecting groove, a liquid guiding groove (24) is provided between two adjacent metal terminals (23), the liquid guiding groove (24) is located at the bottom of the connecting groove (22), a liquid dissipation cavity (25) is further provided inside the communication port body (21), and the liquid guiding groove (24) is connected with the liquid dissipation cavity (25).

10 Claims, 3 Drawing Sheets

(56) References Cited

U.S. PATENT DOCUMENTS

| | | | | |
|---|---|---|---|---|
| 8,662,910 | B2 * | 3/2014 | Ichio | H01R 43/005 439/206 |
| 2003/0219998 | A1 | 11/2003 | Kakuta et al. | |
| 2005/0036100 | A1 * | 2/2005 | Rice | A42B 3/24 351/62 |
| 2006/0144414 | A1 * | 7/2006 | Carballada | A45D 1/04 132/224 |
| 2008/0241624 | A1 * | 10/2008 | Isono | H01M 8/04171 429/437 |
| 2008/0299800 | A1 | 12/2008 | Yoshida et al. | |
| 2009/0022858 | A1 * | 1/2009 | Pawlick | B65D 81/34 426/113 |
| 2009/0114560 | A1 * | 5/2009 | Harshman | B65D 85/505 206/423 |
| 2011/0068665 | A1 | 3/2011 | Cao | |
| 2014/0113497 | A1 | 4/2014 | Wang | |
| 2014/0315413 | A1 | 10/2014 | Lu | |
| 2016/0118744 | A1 * | 4/2016 | Wittrock | H01R 13/5227 439/191 |

FOREIGN PATENT DOCUMENTS

| | | | |
|---|---|---|---|
| CN | 202817348 | U | 3/2013 |
| CN | 103107453 | A | 5/2013 |
| CN | 103594843 | A | 2/2014 |
| CN | 103762445 | A | 4/2014 |
| EP | 2251940 | B1 | 11/2010 |
| EP | 2365589 | A1 | 9/2011 |

OTHER PUBLICATIONS

Extended European Search Report issued in European Application No. 16908498.5 dated Mar. 18, 2019, 5 pages.

International Search Report and Written Opinion issued in International Application No. PCT/CN2016/090199 dated Apr. 19, 2017, 16 pages.

* cited by examiner

WATERPROOF COMMUNICATION PORT AND TERMINAL DEVICE EQUIPPED WITH WATERPROOF COMMUNICATION PORT

CROSS-REFERENCE TO RELATED APPLICATIONS

This application is a national stage of International Application No. PCT/CN2016/090199, filed on Jul. 15, 2016, which is hereby incorporated by reference in its entirety.

TECHNICAL FIELD

The present invention relates to the field of terminal device technologies, and specifically, to a waterproof communication port and a terminal device equipped with the waterproof communication port.

BACKGROUND

As one of the most important ports on a terminal device, a charging port is commonly provided on devices such as a mobile phone and a tablet computer.

Because an existing terminal device tends to be designed and manufactured to be lighter and thinner, the charging port not only provides a charging function to enable the charging port to be used for charging, but also integrates a function of a communication port. The port, for example, a USB port, can be used to perform data communication with another device and provide both a charging function and a data transmission function.

However, because these ports such as the charging port or the communication port on a terminal device are usually exposed to the outside, in a humid environment, a liquid sputtering environment, or another use environment with liquid, a case in which liquid enters a port and causes a short circuit or even a burnout of a circuit board connected to the port easily occurs.

SUMMARY

Embodiments of the present invention provide a waterproof communication port, to resolve a prior-art problem that liquid entering a port easily causes a short circuit or even a burnout of a circuit board connected to the port.

In view of this, a first aspect of the present invention provides a waterproof communication port. The waterproof communication port includes a port body, where a connecting groove is provided on a connecting end that is of the communication port body and configured to connect a corresponding male end or a corresponding female end, metal terminals are provided inside the connecting groove, a liquid guiding groove is provided between two adjacent metal terminals, the liquid guiding groove is located at the bottom of the connecting groove, a liquid dissipation cavity is further provided inside the communication port body, and the liquid guiding groove communicates with the liquid dissipation cavity. It can be learned that in this design, after the communication port body is connected to a corresponding port, liquid enters the liquid guiding groove due to squeezing, and the liquid in the liquid guiding groove is absorbed into the liquid dissipation cavity due to a capillary action and is evaporated. In this way, a waterproofing effect is achieved.

In some embodiments, the liquid guiding groove may be designed at the bottom or on a side of the connecting groove, the liquid guiding groove may include a first liquid guiding section located between two adjacent metal terminals and a second liquid guiding section provided at a tail end of the connecting groove, and the first liquid guiding section is connected to the second liquid guiding section. In this arrangement, the two connected liquid guiding sections are designed along the bottom and a side wall of the liquid guiding groove, so that liquid can flow more smoothly and a waterproofing capability is enhanced.

In some embodiments, the designed two liquid guiding sections communicate with the liquid dissipation cavity by using a liquid guiding channel, the liquid guiding channel is provided inside the communication port body and between the connecting end and the liquid dissipation cavity, and two ends of the liquid guiding channel respectively communicate with the second liquid guiding section and the liquid dissipation cavity. The liquid guiding channel is located inside the communication port body, and can be formed by getting through the liquid dissipation cavity at any position on a path of the second liquid guiding section. A position of the liquid guiding channel may be flexibly arranged within this range.

In some embodiments, to enhance a water absorbing capability of the liquid guiding groove, so that liquid can enter the liquid dissipation cavity more quickly and a better waterproofing capability is provided, a water-absorbent coating may be added on a groove surface of the liquid guiding groove.

In some embodiments, to enhance fitting between the liquid dissipation cavity and the liquid guiding groove and enhance a capillary action, a liquid-absorbent block may be provided inside the liquid dissipation cavity, and one end of the liquid-absorbent block is in contact with the liquid guiding groove. The liquid-absorbent block can generate attraction to liquid in the liquid guiding groove and accelerate the flow of the liquid, thereby further enhancing a waterproofing capability.

In some embodiments, because liquid in the liquid dissipation cavity is finally discharged through evaporation, a vapor guiding channel may be provided on the top of the liquid-absorbent block in the liquid absorbing cavity, so that vapor can be discharged in time and the waterproof communication port has a sustainable waterproofing capability.

In some embodiments, to further improve liquid evaporation and discharge efficiency, a heating block may be provided at a bottom position inside the liquid dissipation cavity. The heating block can accelerate evaporation of liquid in the liquid dissipation cavity by heating the liquid in the liquid dissipation cavity, thereby further enhancing a waterproofing capability.

In some embodiments, to enable liquid to flow smoothly in the liquid guiding groove, the liquid guiding groove may be designed as a U-shaped groove or a V-shaped groove, so that liquid can flow smoothly and does not hold up.

In some embodiments, the communication port body is a plastic bracket, and the liquid guiding groove and the liquid dissipation cavity are an all-in-one structure. The plastic bracket can be insulated, and in addition, facilitates one-step molding. The liquid guiding groove and the liquid dissipation cavity are an all-in-one structure, but not a structure obtained after a plurality of times of machining. In this way, product production efficiency can be improved.

A second aspect of the embodiments of the present invention further provides a terminal device equipped with a waterproof communication port, and the foregoing waterproof communication port is provided inside the terminal device.

It can be learned from the foregoing technical solutions that the embodiments of the present invention have the following advantages: In the embodiments of the present invention, the liquid guiding groove is provided between the metal terminals in the connecting groove, and the liquid dissipation cavity is provided inside the communication port body. In this case, when plug-in and plug-out operations are performed when there is liquid in the communication port, because a gap between the male end and the female end of the communication port is extremely small and the liquid guiding groove is actually an extremely small groove, after the male end and the female end of the communication port fit together, the liquid in the communication port is squeezed into the liquid guiding groove. In addition, the liquid guiding groove further absorbs, into the liquid guiding groove due to a capillary action, some liquid that is not squeezed into the liquid guiding groove. The liquid enters the liquid dissipation cavity along the liquid guiding groove, and the liquid dissipation cavity evaporates the liquid. In this way, the liquid entering the communication port is guided away to resolve a liquid inflow problem of the communication port.

Figure 1:
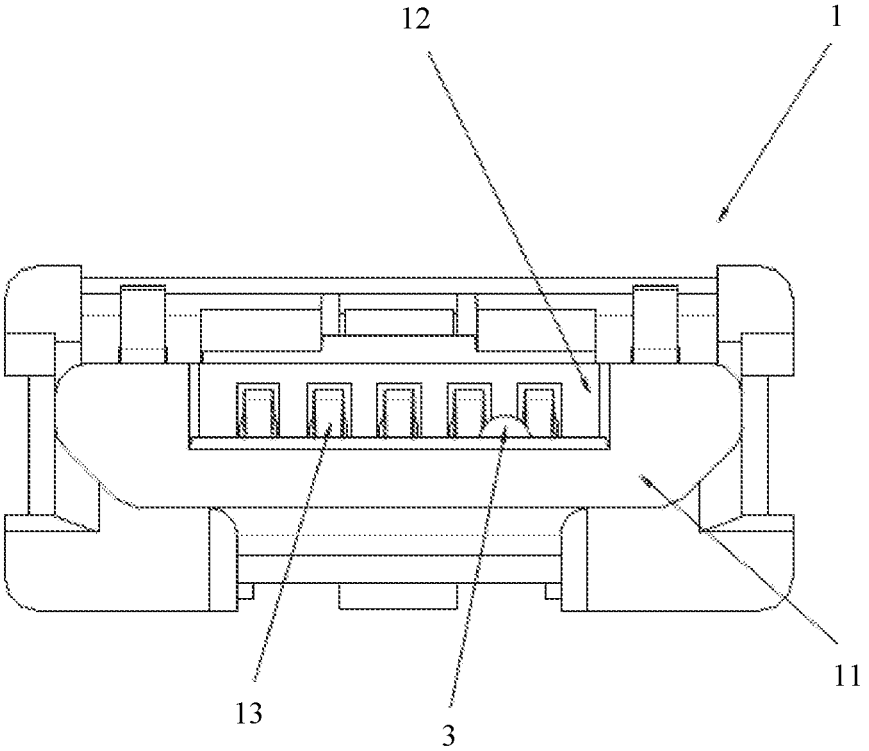
FIG. 1 is a schematic diagram of liquid inflow in an existing communication port.

Components in the accompanying drawings are as follows:

1: Communication port; 11: Port body; 12: Body connecting groove; 13: Metal terminal; 2: Waterproof communication port; 21: Communication port body; 22: Connecting groove; 23: Metal terminal; 24: Liquid guiding groove; 241: First liquid guiding section; 242: Second liquid guiding section; 243: Liquid guiding connecting section; 25: Liquid dissipation cavity; 26: Liquid-absorbent block; 27: Vapor guiding channel; 28: Heating block; 3: Liquid globule; 4: Port base; 41: Base port end.

DESCRIPTION OF EMBODIMENTS

Embodiments of the present invention provide a waterproof communication port to resolve a prior-art problem that liquid entering a port easily causes a short circuit or even a burnout of a circuit board connected to the port.

To make persons skilled in the art understand the technical solutions in the present invention better, the following clearly describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiments of the present invention without creative efforts shall fall in the protection scope of the present invention.

Details are separately described below.

In the specification, claims, and the accompanying drawings of the present invention, the terms "first", "second", "third", "fourth", and the like (if existent) are intended to distinguish between similar objects but do not necessarily indicate a specific order or sequence. It should be understood that the data used in such a way are interchangeable in proper circumstances, so that the embodiments of the present invention described herein can be implemented in other orders than the order illustrated or described herein.

Whether liquid can be prevented from entering a communication port directly affects an applicable environment and a service life of a terminal device equipped with the communication port. If the communication port is not protected, damage problems such as a short circuit and a burnout occur due to liquid inflow, and in addition, even if none of these problems occurs, a coating on a metal housing or a metal terminal is worn down because the communication port is frequently plugged in and plugged out, and a rusting problem occurs. In the prior art, to resolve these two problems, a plug is usually plugged into the communication port, a rubber plug is usually used, and interference fitting is actually performed between the rubber plug and the communication port, so that the rubber plug can be tightly plugged into the communication port. However, when this rubber plug structure is used, specific design space needs to be reserved for designing the rubber plug. This affects an overall product design. In addition, if the rubber plug is not plugged-in or the rubber plug is damaged, a protection effect totally fails, and consequently a relatively limited effect is achieved in actual application.

For example, referring to FIG. 1, FIG. 1 is a schematic diagram of liquid inflow in an existing communication port. A body connecting groove 12 is provided on a port body 11 of the communication port 1, and a plurality of metal terminals 13 are provided in parallel inside the connecting groove. Liquid flows between two adjacent metal terminals. To be specific, there is a liquid globule 3 between the two adjacent metal terminals. If the liquid globule is not discharged in time from the conductive liquid, for example, various types of water that contains impurity or various conductive chemical solutions, after the communication port is connected to a port that is paired with the communication port, the two terminals are easily conducted and then short-circuited.

In view of this, in the embodiments of the present invention, a liquid guiding groove and a liquid dissipation cavity are provided inside a communication port, to help discharge liquid from the communication port. There are a plurality of communication ports applied in the embodiments of the present invention, for example, universal serial bus (Universal Serial Bus, USB) ports of various versions, such as USB type-A, USB type-B, and USB type-C, and a USB port of a USB standard such as USB 1.0, USB 2.0, USB 3.0, or USB 3.1. In other words, the method in the embodiments of the present invention can be used provided that the communication port is a structure in which metal terminals are located inside a connecting groove and a specific distance is reserved between the metal terminals.

Figure 2:
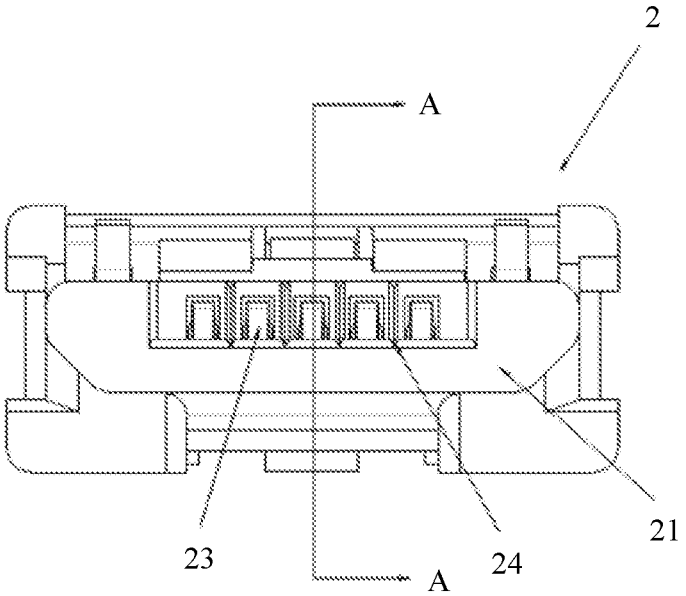
FIG. 2 is a diagram of an embodiment of a waterproof communication port according to an embodiment of the present invention.
Figure 3:
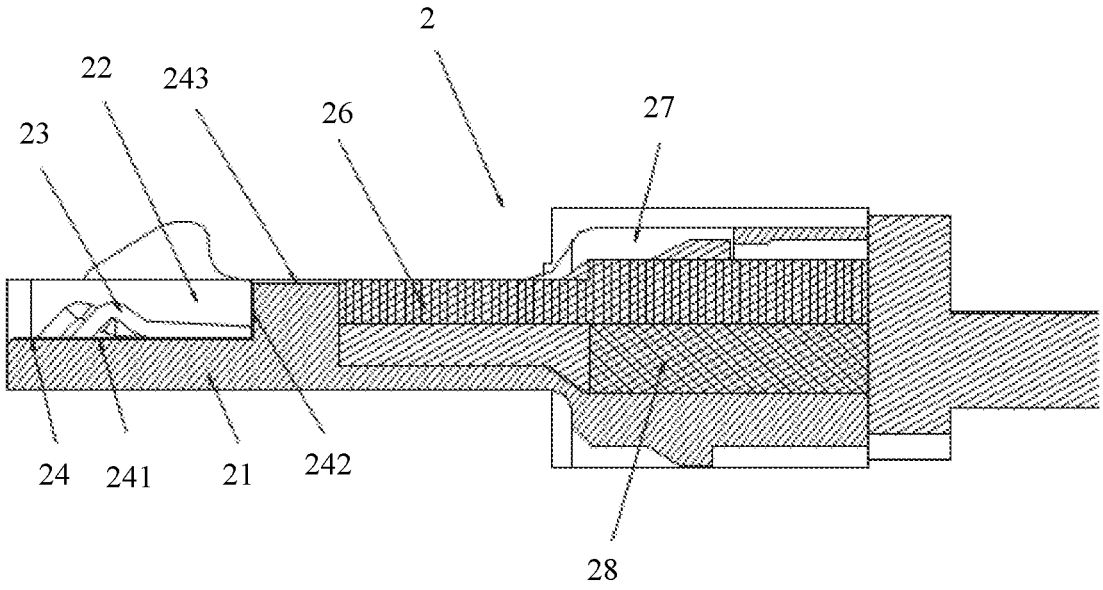
FIG. 3 is a sectional view of A-A in FIG. 2.
Figure 4:
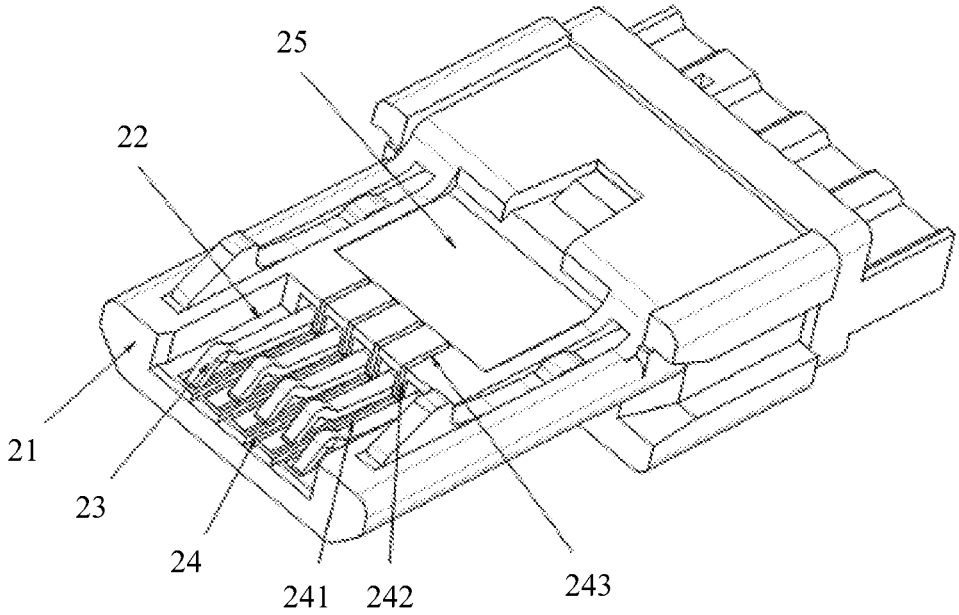
FIG. 4 is a diagram of another embodiment of a waterproof communication port according to an embodiment of the present invention.

A waterproof communication port according to an embodiment of the present invention is described below. Referring to FIG. 2 to FIG. 4, FIG. 2 is a diagram of an embodiment of a waterproof communication port according to an embodiment of the present invention, FIG. 3 is a sectional view of A-A in FIG. 2, and FIG. 4 is a diagram of another embodiment of a waterproof communication port according to an embodiment of the present invention. The waterproof communication port 2 may include a communication port body 21, a connecting groove 22 is provided on a connecting end of the communication port body, metal terminals 23 are provided inside the connecting groove, a liquid guiding groove 24 is provided at the bottom of the connecting groove and between two adjacent metal terminals, a liquid dissipation cavity 25 is further provided inside the communication port body, and the liquid guiding groove communicates with the liquid dissipation cavity.

Optionally, a water-absorbent coating is provided on a groove surface of the liquid guiding groove. The coating can help the liquid guiding groove absorb water, so that liquid can enter the liquid guiding groove more quickly and be discharged to the liquid dissipation cavity. The water-absorbent coating may be made of a plurality of different materials, for example, a waterborne polyurethane material, a super absorbent polymer (Super Absorbent Polymer, SAP) material, and a modified epoxy material. A specific material may be selected based on an actual application environment of the communication port. Herein, no limitation is imposed.

It should be noted that a shape of the liquid guiding groove has some impact on a liquid guiding capability of the liquid guiding groove. To achieve a better liquid guiding effect, the liquid guiding groove is a U-shaped groove or a V-shaped groove. Regardless of the U-shaped groove or the V-shaped groove, the design of the bottom of the groove enables liquid to flow rapidly in the groove to avoid being easily hung in a corner of the groove and consequently failing to be discharged. Because the liquid guiding groove is actually an extremely small groove, after a male end and a female end of the communication port fit together, when there is liquid in the connecting groove, the liquid guiding groove absorbs the liquid into the liquid guiding groove due to a capillary action, and then further transfers the liquid to the liquid dissipation cavity.

It can be learned that, in this embodiment of the present invention, the liquid guiding groove is provided between the metal terminals in the connecting groove, and the liquid dissipation cavity is provided inside the communication port body. In this case, when plug-in and plug-out operations are performed when there is liquid in the communication port, because a gap between the male end and the female end of the communication port is extremely small and the liquid guiding groove is actually an extremely small groove, after the male end and the female end of the communication port fit together, the liquid in the communication port is squeezed into the liquid guiding groove. In addition, the liquid guiding groove further absorbs, into the liquid guiding groove due to a capillary action, some liquid that is not squeezed into the liquid guiding groove. The liquid enters the liquid dissipation cavity along the liquid guiding groove, and the liquid dissipation cavity evaporates the liquid. In this way, the liquid entering the communication port is guided away to resolve a liquid inflow problem of the communication port.

Optionally, the liquid guiding groove includes a first liquid guiding section 241 located between two adjacent metal terminals and a second liquid guiding section 242 provided at a tail end of the connecting groove, and the first liquid guiding section is connected to the second liquid guiding section. It may be understood that, because one end of the connecting groove is actually blocked by the communication port body, a manner of connecting the liquid guiding groove through the liquid dissipation cavity is that the liquid guiding groove is arranged on a surface of the communication port body. In this way, the liquid guiding groove includes the first liquid guiding section and the second liquid guiding section. In addition, because the first liquid guiding section and the second liquid guiding section are arranged on the surface of the communication port body, liquid can be effectively discharged when the first liquid guiding section and the second liquid guiding section are connected to the other side of the communication port.

It should be noted that, due to different designs of the liquid guiding groove, there are two different structures for connecting the liquid guiding groove to the liquid dissipation cavity. The following separately describes the two different structures.

1. The liquid guiding groove and the liquid dissipation cavity are connected inside the communication port body. Optionally, a liquid guiding channel is provided inside the communication port body and between the connecting end and the liquid dissipation cavity, and two ends of the liquid guiding channel respectively communicate with the second liquid guiding section and the liquid dissipation cavity.

It may be understood that the liquid guiding channel is actually located inside the communication port body. Therefore, a connecting end of the liquid guiding channel may be provided at any position on the second liquid guiding section. When the waterproof communication port is connected to the other end of the communication port, because liquid at any position of the liquid guiding groove can enter the liquid guiding channel through squeezing, to complete a liquid discharge process, the liquid guiding channel may be a linear-type structure or may be a curve-type structure, a broken line-type structure, or the like. A specific structure may be designed based on the communication port body. Herein, no limitation is imposed.

2. The liquid guiding groove and the liquid dissipation cavity are connected on the surface of the communication port body. Optionally, the liquid guiding groove further includes a liquid guiding connecting section 243 arranged on the surface of the communication port body and between the connecting end and the liquid dissipation cavity, and two ends of the liquid guiding connecting section respectively communicate with the second liquid guiding section and the liquid dissipation cavity.

It may be understood that, in this manner, one end of the liquid guiding connecting section is connected to a tail end of the second liquid guiding section, and the other end is connected to the liquid dissipation cavity. A structure of this liquid guiding connecting section may be the same as or different from that of the first liquid guiding section and that of the second liquid guiding section. In this manner, three sections of the liquid guiding groove can be completed by performing one-step machining on the communication port body, and the liquid guiding groove arranged along the communication port body can enable all liquid to enter the liquid dissipation cavity along a same direction, thereby improving liquid guiding efficiency of the liquid guiding groove.

Figure 5:
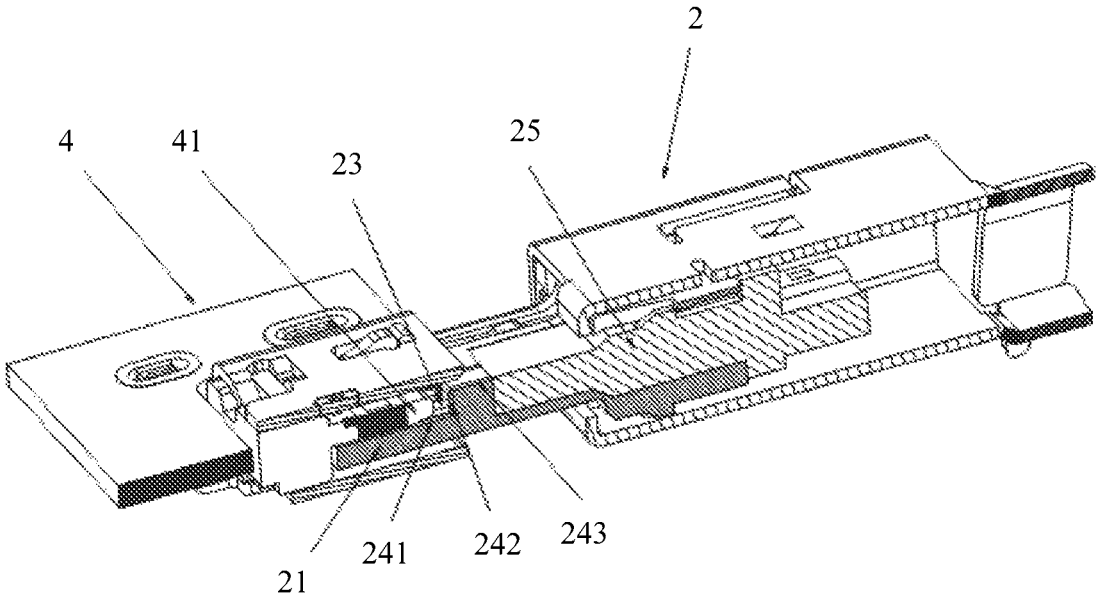
FIG. 5 is a diagram of still another embodiment of a waterproof communication port according to an embodiment of the present invention.

For example, referring to FIG. 5, FIG. 5 is a diagram of still another embodiment of a waterproof communication port according to an embodiment of the present invention. FIG. 5 shows a connection structure between the waterproof communication port and a corresponding port base 4. When there is liquid in the connecting groove of the waterproof communication port, a base port end 41 in the port base and the connecting groove fit together to squeeze liquid into the liquid guiding groove. The liquid flows through the first liquid guiding section, the second liquid guiding section, and the liquid guiding connecting section due to a capillary action, and finally enters the liquid dissipation cavity, thereby implementing a waterproofing function of the waterproof communication port.

It should be noted that the waterproof communication port may directly adapt to an existing port base, or may adapt to a protruding port base that is provided corresponding to the liquid guiding groove, and such a port base can further discharge liquid through squeezing.

Optionally, to improve liquid discharge efficiency, a liquid-absorbent block 26 may be provided inside the liquid dissipation cavity, and one end of the liquid-absorbent block is in contact with the liquid guiding groove. The liquid-absorbent block is to provide a specific liquid absorbing capability to enable liquid in the liquid guiding groove to flow more rapidly, thereby improving liquid discharge efficiency. A plurality of materials can be selected for the liquid-absorbent block, for example, a water absorbent silica gel material, or for another example, a water-absorbent foam material. All these materials can improve liquid absorption efficiency by using characteristics of the materials, so that liquid discharge efficiency of the communication port is improved.

In addition, to enable liquid in the liquid dissipation cavity to be smoothly discharged from the communication port, optionally, a vapor guiding channel 27 is provided on the top of the liquid-absorbent block in the liquid absorbing cavity. In a design, the vapor guiding channel may include a plurality of relatively small holes or may include several relatively large holes. One end of these holes is connected to an external environment, and the other end is connected to the liquid dissipation cavity, so that the liquid in the liquid dissipation cavity can be rapidly discharged after being vaporized, and therefore liquid discharge efficiency is improved.

It should be noted that, to further improve the liquid discharge efficiency, the liquid in the liquid dissipation cavity may be heated, so that a vaporization process of the liquid is accelerated. Optionally, a heating block 28 configured to heat the liquid dissipation cavity is further provided at the bottom of the heat dissipation cavity. It may be understood that the heating block may be an electric heating block. Because the communication port has an extremely small volume, a current flowing through the communication port is sufficient for heating the electric heating block. In this way, temperature in the liquid dissipation cavity is raised, the liquid in the liquid dissipation cavity is vaporized rapidly, and the liquid can be quickly discharged through the vapor guiding channel, so that liquid discharge efficiency is improved.

Optionally, the communication port body is a plastic bracket, and the liquid guiding groove and the liquid dissipation cavity are an all-in-one structure. It may be understood that, to ensure an insulation effect, the communication port body is usually made of an insulating material, for example, plastic. In this case, the communication port body may be actually a plastic bracket, the metal terminals are mounted inside the plastic bracket, and both the liquid guiding groove provided on the plastic bracket and the liquid dissipation cavity provided inside the plastic bracket may be integrated through one-step molding.

The waterproof communication port according to the embodiments of the present invention is described above. A terminal device equipped with the waterproof communication port according to an embodiment of the present invention is described below. The waterproof communication port shown in FIG. 2 to FIG. 5 is provided inside the terminal device. It may be understood that the terminal device equipped with the waterproof communication port has a liquid discharge effect of the waterproof communication port shown in FIG. 2 to FIG. 5, and therefore a short circuit or a burnout does not occur in a circuit inside the terminal device.

In addition, for some terminal devices with anti-shock, waterproof and dustproof functions or a specific waterproof function, a housing of the terminal device may be hermetically connected to the waterproof communication port. There may be a plurality of hermetical connection manners, for example, sealing using a seal ring, sealing through adhesive bonding, and sealing through interference fitting. All these connection manners can implement a hermetical connection effect. A specific manner may be determined based on a specific product design. Herein, no limitation is imposed.

It may be clearly understood by persons skilled in the art that, for the purpose of convenient and brief description, for a detailed working process of the foregoing system, apparatus, and unit, refer to a corresponding process in the foregoing method embodiments, and details are not described herein.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of a software functional unit.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. A waterproof communication port, comprising a communication port body, wherein:

a connecting groove is provided on a connecting end of the communication port body, metal terminals are provided inside the connecting groove, a liquid guiding groove is provided at the bottom of the connecting groove and between two adjacent metal terminals, a liquid dissipation cavity is further provided inside the communication port body, and wherein:

the liquid guiding groove is connected with the liquid dissipation cavity;

a liquid-absorbent block is provided inside the liquid dissipation cavity;

one end of the liquid-absorbent block is in contact with the liquid guiding groove; and a vapor guiding channel is provided on top of the liquid-absorbent block.

2. The waterproof communication port according to claim 1, wherein a water-absorbent coating is provided on a groove surface of the liquid guiding groove.

3. The waterproof communication port according to claim 1, wherein a heating block configured to heat the liquid dissipation cavity is further provided at the bottom of the liquid dissipation cavity.

4. The waterproof communication port according to claim 1, wherein the liquid guiding groove is a U-shaped groove or a V-shaped groove.

5. The waterproof communication port according to claim 1, wherein the communication port body is a plastic bracket, and the liquid guiding groove and the liquid dissipation cavity are an all-in-one structure.

6. The waterproof communication port according to claim 1, wherein the liquid guiding groove comprises a first liquid guiding section located between two adjacent metal terminals and a second liquid guiding section provided at a tail end of the connecting groove, and the first liquid guiding section is connected to the second liquid guiding section.

7. The waterproof communication port according to claim 6, wherein a liquid guiding channel is provided between the connecting end and the liquid dissipation cavity, and two ends of the liquid guiding channel are respectively connected with the second liquid guiding section and the liquid dissipation cavity.

8. The waterproof communication port according to claim 6, wherein the liquid guiding groove further comprises a liquid guiding connecting section arranged on a surface of the communication port body and between the connecting end and the liquid dissipation cavity, and two ends of the liquid guiding connecting section respectively are respectively connected with the second liquid guiding section and the liquid dissipation cavity.

9. A terminal device equipped with a waterproof communication port, wherein the terminal device is equipped with a waterproof communication port comprising a communication port body, wherein:

a connecting groove is provided on a connecting end of the communication port body, metal terminals are provided inside the connecting groove, a liquid guiding groove is provided at the bottom of the connecting groove and between two adjacent metal terminals, a liquid dissipation cavity is further provided inside the communication port body, and wherein:

the liquid guiding groove is connected with the liquid dissipation cavity;

a liquid-absorbent block is provided inside the liquid dissipation cavity;

one end of the liquid-absorbent block is in contact with the liquid guiding groove; and a vapor guiding channel is provided on top of the liquid-absorbent block.

10. The terminal device equipped with a waterproof communication port according to claim 9, wherein a housing of the terminal device is hermetically connected to the waterproof communication port.

* * * * *